US006157349A

United States Patent [19]

Crouch

[11] Patent Number: 6,157,349

[45] Date of Patent: Dec. 5, 2000

[54] MICROWAVE SOURCE SYSTEM HAVING A HIGH THERMAL CONDUCTIVITY OUTPUT DOME

[75] Inventor: David D. Crouch, Corona, Calif.

[73] Assignee: Raytheon Company, Lexington, Mass.

[21] Appl. No.: 09/275,483

[22] Filed: Mar. 24, 1999

[51] Int. Cl.[7] ..... H01Q 1/42

[52] U.S. Cl. ..... 343/872

[58] Field of Search ..... 343/872, 873; 244/121; 428/215

[56] References Cited

U.S. PATENT DOCUMENTS

| | | | |
|---|---|---|---|
| 2,962,717 | 11/1960 | Kofoid | 343/872 |
| 3,292,544 | 12/1966 | Caldwell et al. | 343/872 |
| 3,383,444 | 5/1968 | Loyet | 343/872 |
| 3,396,400 | 8/1968 | Kelly et al. | 343/872 |
| 4,677,443 | 6/1987 | Koetje et al. | 343/872 |
| 5,691,736 | 11/1997 | Hunn et al. | 343/872 |
| 5,738,750 | 4/1998 | Purinton et al. | 156/325 |

*Primary Examiner*—Tan Ho

*Attorney, Agent, or Firm*—David W. Collins; Glenn H. Lenzen, Jr.

[57] ABSTRACT

A microwave source system includes a magnetron source having an antenna, and an output dome covering the antenna. The output dome is formed as a ceramic substrate having an inner surface and an outer surface, and a conductive layer of a high thermal conductivity material overlying and contacting the inner surface and/or the outer surface. The ceramic substrate is preferably fused quartz, and the conductive layer is preferably polycrystalline synthetic diamond.

19 Claims, 4 Drawing Sheets

| MATERIAL | LOSS FACTOR | THERM COND. (BARE) | THERM COND. (W/LAYER)[1] | COEFF. OF THERMAL EXPANSION[2] | F (BARE) | F (W/LAYER) |
|---|---|---|---|---|---|---|
| ALUMINA | 0.0008 | 26 | 63.5 | 8.2 | 1 | 2.4 |
| BERYLLIUM OXIDE | 0.001 | 201 | 231.7 | 6.4 | 7.9 | 9.1 |
| FUSED QUARTZ | 0.0014 | 0.84 | 39.3 | 0.55 | 0.28 | 13.1 |
| SAPPHIRE (PARALLEL) | 0.0022 | 25 | 62.5 | 8.6 | 0.33 | 0.825 |
| SILICON NITRIDE | 0.00486 | 35 | 72.1 | 3.5 | 0.52 | 1.07 |
| ALUMINUM NITRIDE | 0.00172 | 80 | 115.4 | 4.3 | 2.7 | 3.9 |
| POLYCRYSTALLINE DIAMOND | 0.00342 | 1000 | N/A | 1.2 | 61.5 | N/A |

NOTE 1 - MEASURED IN W/m-°C
NOTE 2 - MEASURED IN $10^{-6}$ m/m-°C
NOTE 3 - N/A MEANS NOT APPLICABLE

FIG. 7

MICROWAVE SOURCE SYSTEM HAVING A HIGH THERMAL CONDUCTIVITY OUTPUT DOME

This invention was made with Government support under Contract No. F29601-92-C-0124 awarded by Department of the Air Force. The Government has certain rights in this invention.

BACKGROUND OF THE INVENTION

This invention relates to magnetron microwave sources, and, more particularly, to a magnetron microwave source having an antenna covered by an output dome.

Microwaves are radio frequency energy used in a wide variety of commercial and military systems. Microwaves have frequencies in the range of from about 0.9 to about 100 GHz (gigahertz). Their applications include, for example, microwave ovens, microwave radar, microwave communications, and materials deposition.

Microwaves may be generated in any of a variety of microwave source systems. A typical magnetron microwave source system, for example, includes a cylindrical cathode and a surrounding anode having inwardly extending vanes that define a series of resonant cavities. A magnetic field is applied parallel to the cylindrical axis by strong magnets located at the ends of the cathode and anode. A microwave antenna is provided at one end of the structure in communication with the anode. The microwave source system is enclosed in a housing so that it may be evacuated.

In operation, electrons are emitted from the cathode into the space between the cathode and the anode and accelerated toward the anode by an applied electric field. The electrons are forced to move in an expanding circular orbit about the cathode by the simultaneously applied magnetic field. As the electrons pass by the resonant cavities, they generate a continuously oscillating electromagnetic field. The frequency of the electromagnetic field is determined by the configuration of the resonant cavities. The electromagnetic energy is conducted into the antenna, from which it is radiated into a launcher and thence into a waveguide output transmission line. A wide variety of magnetron and other types of microwave sources are known. The above discussion is for general background purposes, and is not intended to be exhaustive or detailed.

The microwave antenna is covered with an output dome made of a ceramic material such as aluminum oxide (alumina). The ceramic output dome forms part of the vacuum enclosure that permits the cathode, anode, and related structure to be evacuated. Because the output dome has a low electrical conductivity and low electrical loss factor, it permits the passage therethrough of the microwave energy that is radiated from the microwave antenna.

The ceramic output dome may be a limiting consideration in the output power of the microwave source system. In some high-average-power applications, the ceramic output dome is observed to crack from the influence of the absorbed microwave energy. The vacuum is thereby lost and the microwave source system becomes inoperable.

There is a need for an improved microwave source system which does not suffer from loss of function as a result of ceramic output dome failures. The present invention fulfills this need, and further provides related advantages.

SUMMARY OF THE INVENTION

The present invention provides a microwave source system having an improved ability to operate at high average microwave power levels without failure of the output dome. The basic microwave generating structure of the microwave source is not altered, so that the approach of the invention may be used with a wide variety of existing and future microwave sources.

In accordance with the invention, a microwave source system comprises a microwave source including an antenna, and an output dome covering the antenna. The output dome comprises a ceramic substrate having an inner surface and an outer surface, and a conductive layer of a high thermal conductivity material overlying and contacting at least one of the inner surface and the outer surface.

The inventor has observed that the failure of prior ceramic output domes is linked to their inability to dissipate the heat that is produced in them by the passage therethrough of the microwave output energy. Ceramics generally have a low thermal conductivity. Although they also have low electrical conductivity and low electrical loss factor, some heat is generated resistively in a spatially nonuniform manner by the passage of the microwave energy. This generated heat cannot be dissipated sufficiently rapidly, leading to cracking of the ceramic output dome by differential thermal expansion and other mechanisms.

The present approach increases the thermal conductivity of the ceramic output dome, and thence its ability to dissipate heat generated during service. The incidence of thermal cracking is reduced, increasing the microwave power that may be transmitted through the output dome without failure.

As used herein, a "high thermal conductivity material" is a material having a thermal conductivity greater than that of the ceramic substrate. A preferred high thermal conductivity material is polycrystalline synthetic diamond, but other materials having a high thermal conductivity and low electrical loss factor may also be used. The thermal conductivity of the conductive layer is preferably at least about 500 watts/meter-° C. Its electrical loss factor is preferably less than about 0.010, and most preferably less than about 0.005.

The conductive layer may be applied over the inner surface of the ceramic substrate, the outer surface of the ceramic substrate, or both surfaces of the ceramic substrate. It may be applied as a continuous layer, or in a discontinuous pattern such as strips of the conductive material. The conductive layer may be deposited directly onto the surface of the substrate, or it may be fabricated separately and then bonded onto the substrate. If the conductive material cannot be deposited or bonded onto the surface of the conventional curved ceramic output dome, the substrate may be made in prismatic form with flat sides to accommodate the conductive material.

The present invention provides a microwave source system with improved output performance and increased output power, by increasing the thermal conductivity of the ceramic output dome and thence reducing its disposition toward early failure by thermally induced mechanisms. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 7 is a table of properties of various materials suitable for use in the output dome.

DETAILED DESCRIPTION OF THE INVENTION

Figure 1:
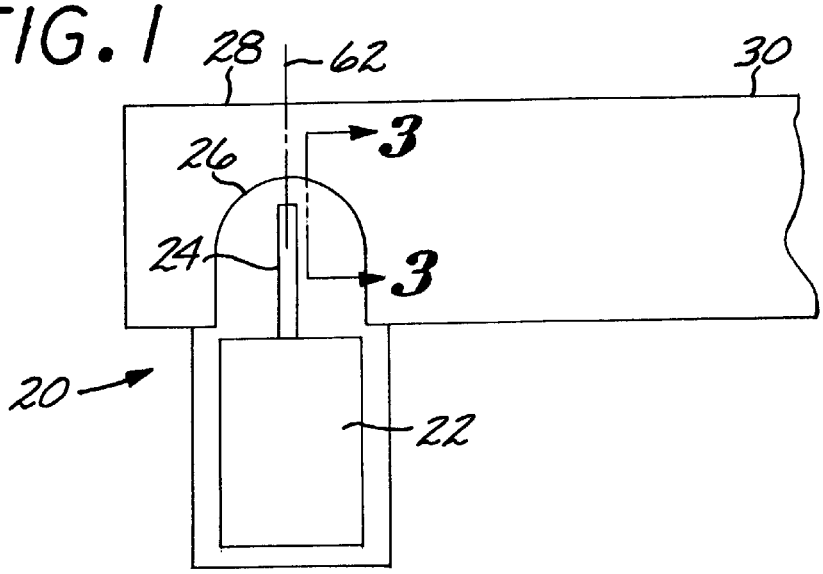
FIG. 1 is a schematic diagram of a microwave source system.

FIG. 1 illustrates a microwave source system 20. The microwave source system 20 includes a microwave source 22 of any operable type, which generates microwave energy. A number of such microwave sources 22 are known in the art. The energy is emitted from the microwave source 22 by an antenna 24. The antenna is covered by an output dome 26. In a typical application, the antenna 24, and thence the output dome 26, project into the interior of an output transmission line in the form of a waveguide launcher 28 and a waveguide 30.

Figure 2:
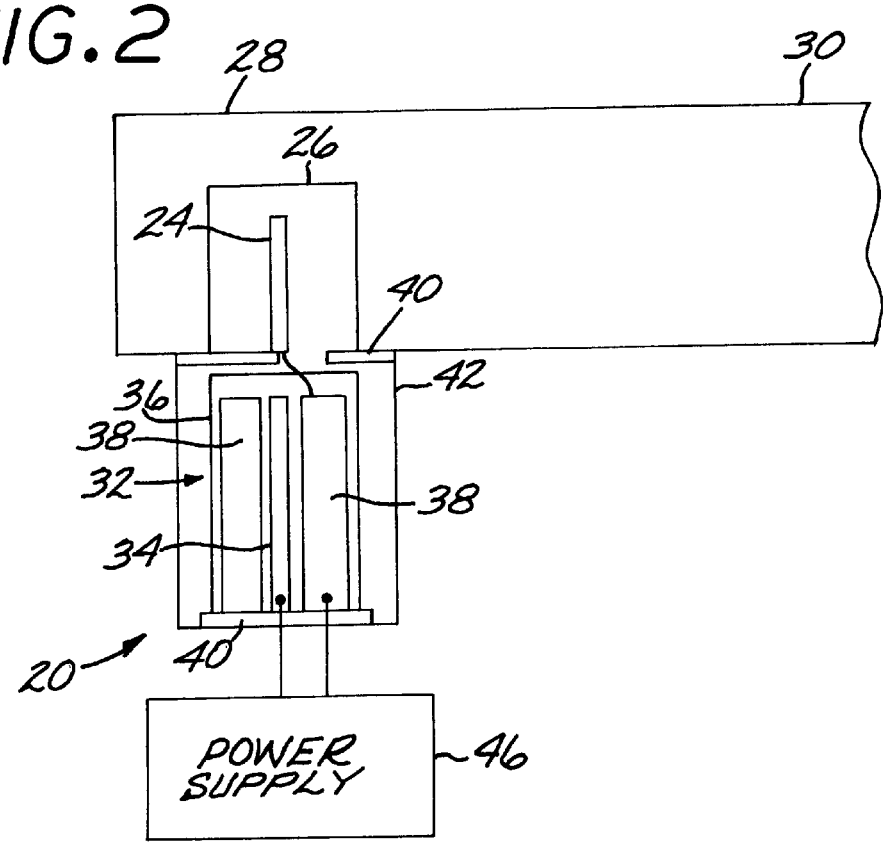
FIG. 2 is a schematic diagram of a magnetron microwave source system.

FIG. 2 depicts a preferred microwave source system 20 utilizing a magnetron microwave source 32. Some of the same elements are present in the microwave source system of FIG. 2 as in FIG. 1. The same numerals are utilized for these elements in FIG. 2, and the above description is incorporated for these elements.

The magnetron microwave source 32 includes a central cathode 34. An annular anode 36 lies radially outwardly from the cathode 34. Anode vanes 38 extend inwardly from a body of the anode 36, defining a series of circumferentially positioned radiating cavities. The antenna 24 is in electrical communication with the anode 36. Permanent magnets 40 (or electromagnets) lie at each end of the cathode and the anode. A vacuum housing 42 surrounds these elements, with the output dome 26 forming a part of the housing. An emitter voltage for the cathode 34 and a fixed voltage between the cathode 34 and the anode 36 are supplied by a power supply 46. This structure for the magnetron microwave source 32 is known in the art.

Figure 3:
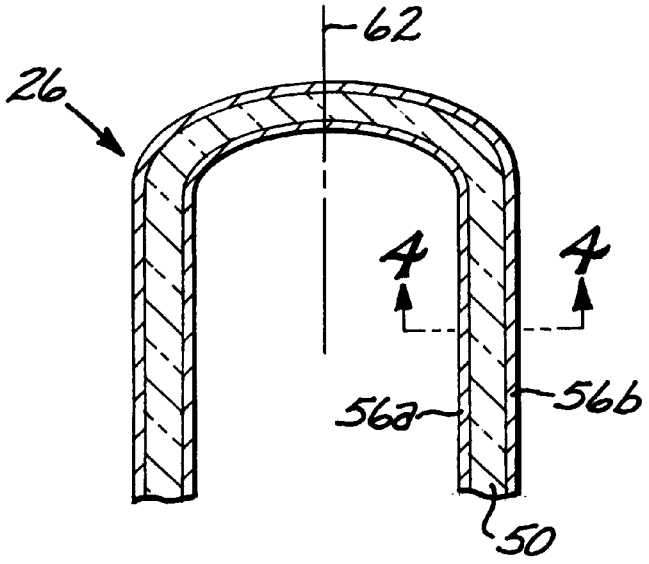
FIG. 3 is a sectional view of an output dome according to the invention.
Figure 4:
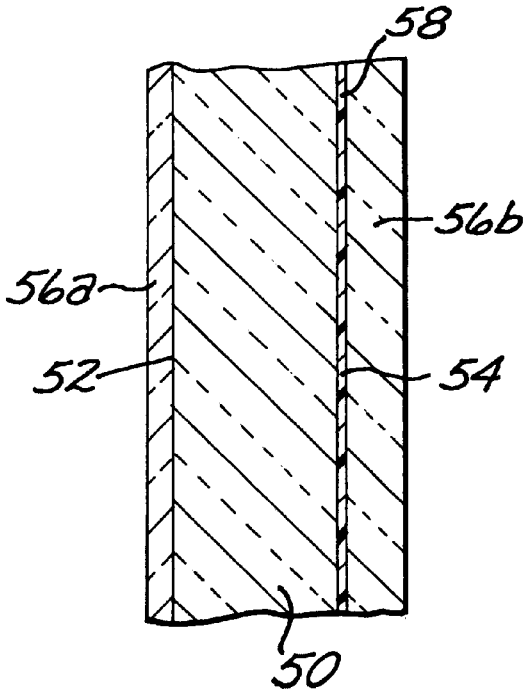
FIG. 4 is a detail of FIG. 3, taken in area 4—4.

FIGS. 3 and 4 depict the output dome 26 of the invention in greater detail. The output dome 26 includes a substrate 50 having an inner surface 52 and an outer surface 54. A conductive layer 56 of a high thermal conductivity material overlies and contacts at least one of the inner surface 52 and the outer surface 54. In the illustrated case, the conductive layer 56 includes both an inner conductive layer 56*a* overlying and contacting the inner surface 52 and an outer conductive layer 56*b* overlying and contacting the outer surface 54. In other embodiments, only an inner conductive layer 56*a* is present, and in still other embodiments, only an outer conductive layer 56*b* is present.

The substrate 50 is preferably a ceramic material having a low electrical loss factor of less than about 0.010, most preferably less than about 0.005. The substrate 50 preferably has as high a thermal conductivity as possible, but no known materials have the desired thermal conductivity and also may be fabricated as structural domes. Examples of operable substrate materials include aluminum oxide (optionally in its sapphire form), beryllium oxide, silicon nitride, aluminum nitride, and quartz, with quartz being preferred.

The conductive layer 56 is a material having a high thermal conductivity. As used herein, a "high thermal conductivity material" is a material having a thermal conductivity significantly greater than that of the substrate 50. The conductive layer 56 has a thermal conductivity that is preferably greater than about 500 watts/meter-° C. However, the conductive layer 56 must also have an electrical loss factor that is relatively low, so that the output of the antenna 24 is not greatly attenuated. The electrical loss factor of the conductive layer 56 is less than about 0.010, most preferably less than about 0.005. If the electrical loss factor is greater, the output dome 26 will absorb too much of the radiated microwave energy and become overheated and otherwise inoperable. Examples of operable materials for the conductive layer 56 include polycrystalline synthetic diamond and cubic boron nitride, with polycrystalline synthetic diamond being preferred. Polycrystalline synthetic diamond has a thermal conductivity of about 1000 watts per meter per ° C., and an electrical loss factor of about 0.00342.

A figure of merit has been defined to evaluate candidate combinations of the substrate 50 and the conductive layer 56 for use as the output dome 26. The figure of merit F is defined as $$F = \text{Thermal Conductivity}/[(\text{Loss Factor})(\text{Coefficient of Thermal Expansion})]$$

The effective thermal conductivity $k_{eff}$ of the composite structure formed of the substrate 50 and the conductive layer 56 is $$k_{eff} = [k_{sub} + 2k_{cond} f(d_{cond}/d_{sub})]/[1 + 2f(d_{cond}/d_{sub})]$$

where "k" refers to thermal conductivity, "sub" refers to the substrate 50, "cond" refers to the conductive layer 56, and f is the fraction of the surface of the substrate 50 that is covered by the conductive layer 56.

The values of F have been calculated for flat, bare ceramic pieces having a thickness of 5 millimeters ("bare"), and for the same ceramic pieces having a 1 millimeter thick layer of polycrystalline synthetic diamond bonded to each surface 52 and 54 ("w/layer") covering 10 percent of the area of the piece. In the table of FIG. 7, the values of F are normalized to those of bare alumina.

In the absence of the conductive layer 56, beryllium oxide is the leading candidate for the output dome 26, based upon these data of FIG. 7. (Polycrystalline synthetic diamond, while having a high "bare" figure of merit, cannot be fabricated as a freestanding output dome by available technology.) However, beryllium oxide may be difficult and dangerous to process, so that its use is disfavored in spite of its high figure of merit. Bare fused quartz is not a good candidate material, because of its low thermal conductivity, but would otherwise be a candidate material because of its low coefficient of thermal expansion. The low thermal conductivity of fused quartz is obviated by the use of the conductive layer, so that the figure of merit for the fused quartz with the conductive layer is the greatest of any of the materials systems, and over 13 times greater than that of the currently used alumina output dome material.

Based upon this analysis, the combination of a fused quartz substrate 50 and a polycrystalline synthetic diamond conductive layer 56 is most preferred. This combination achieves good thermal and electrical performance, and minimizes thermal expansion mismatch between the substrate and the conductive layer.

The high thermal conductivity of the conductive layer 56 serves to conduct heat generated within the substrate 50. The temperature of the substrate 50 is maintained within operating limits. Excessively large temperature gradients are avoided within the substrate, which, if present, could cause cracking of the substrate due to differential thermal expansion. The low electrical loss factor of conductive layer 56 (and the substrate 50) allow the microwave electromagnetic energy to be transmitted therethrough with little loss and little heating.

The substrate 50 has a thickness dictated by the frequency of operation and by the structural requirements of the system, but is typically from about 1 millimeter to about 15 millimeters thick. The conductive layer 56 has a thickness dictated by heat flow requirements and available fabrication techniques. The conductive layer 56 may be deposited directly upon the surface of the substrate 50 by chemical vapor deposition or other techniques, in thicknesses up to about 20 micrometers in reasonable times. If a thicker conductive layer 56 is desired, the conductive layer 56 may be fabricated as a freestanding element by techniques such as chemical vapor deposition and then bonded to the substrate. Such freestanding conductive layers are available in thicknesses of up to 2–3 millimeters, from sources such as Crystalline Materials Corporation, Phoenix, Ariz. For illustration, in FIG. 4 (which is not drawn to scale) the inner conductive layer 56*a* is shown as relatively thin, as would be the case if it were deposited directly onto the inner surface 52. The outer conductive layer 56*b* is shown as relatively thick, as would be the case if it were fabricated as a freestanding element and then bonded onto the outer surface with an adhesive layer 58. An acceptable adhesive material for bonding polycrystalline diamond to quartz, for example, is a ceramic adhesive such as Ceramabond 618 from Aremco Products, Inc., which has a maximum service temperature of as high as 1000° C.

Figure 5:
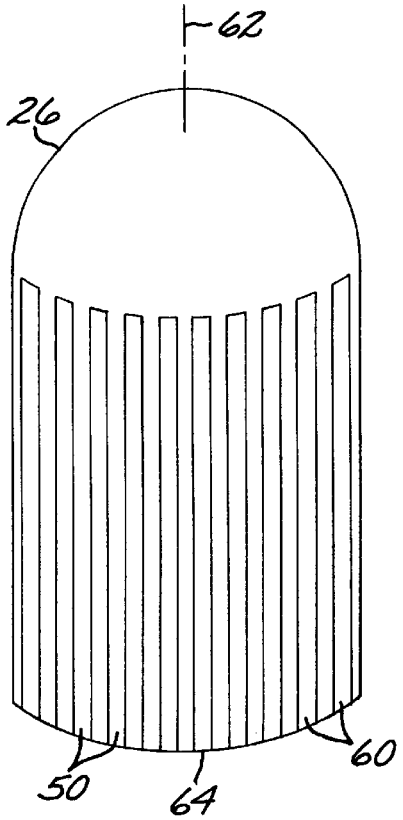
FIG. 5 is an embodiment of the microwave output dome, with a striped conductive layer.
Figure 6:
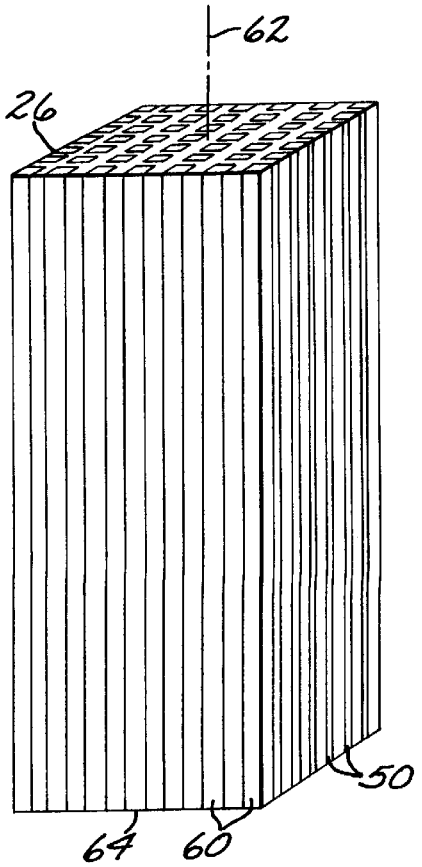
FIG. 6 is a prismatic embodiment of the microwave output dome, with a striped conductive layer.

Traditionally, the output dome 26 has been in the form of a straight-sided cylinder with a substantially hemispherical dome cap, as shown in FIG. 5. The present invention is operable with such an output dome 26. However, when the material of the conductive layer 56 is furnished as freestanding elements and then bonded to the substrate 50, the material may not be available in shapes that conform to the cylindrical and hemispherical surfaces. For example, with today's fabrication technology, freestanding sheets of polycrystalline synthetic diamond are available only as flat pieces, not with curvatures. To permit the use of freestanding pieces of this material, the output dome 26 may be reconfigured in a prismatic form, with flat sides and a flat end, as shown in FIG. 6 for a rectangular prismatic output dome 26. The commercially available flat sheets may be bonded to the inner and/or outer flat surfaces of this prismatic form, as described previously.

The conductive layer 56 may cover the entire inner surface 52 and/or the outer surface 54 of the output dome 26. The conductive layer 56 may instead cover only a portion of the inner surface 52 and/or the outer surface 54. The partial coverage, where used, would be selected to achieve the thermal control functions discussed earlier. FIG. 5 illustrates a cylindrical/hemispherical output dome 26 having a conductive layer 56 in the form of a series of stripes 60 of the material of the conductive layer. FIG. 6 illustrates the rectangular prismatic dome with a similar striped configuration of the conductive layer. The stripes 60 may be of any width and thickness consistent with the fabrication technology used. The stripes 60, where used, preferably extend parallel to a longitudinal axis 62 of the output dome 26, to conduct heat from the upper portions of the output dome 26 toward the heat sinking structure to which its base 64 is attached. When the conductive layer 56 is in the form of these stripes 60, the substrate 50 is visible between the stripes.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A microwave source system, comprising:

a microwave source including an antenna; and a chemically inhomogeneous output dome covering the antenna, the output dome comprising a ceramic substrate having an inner surface and an outer surface, and a conductive layer of a high thermal conductivity ceramic material overlying and contacting at least one of the inner surface and the outer surface, the conductive layer being made of a ceramic having a chemical composition different from that of the ceramic substrate.

2. The microwave source system of claim 1, wherein the conductive layer has a thermal conductivity of at least about 500 watts/meter-° C.

3. The microwave source system of claim 1, wherein the conductive layer has an electrical loss factor of less than about 0.010.

4. The microwave source system of claim 1, wherein the conductive layer has an electrical loss factor of less than about 0.005.

5. The microwave source system of claim 1, wherein the conductive layer is continuous.

6. The microwave source system of claim 1, wherein the conductive layer is discontinuous.

7. The microwave source system of claim 1, wherein the conductive layer overlies and contacts the inner surface.

8. The microwave source system of claim 1, wherein the conductive layer overlies and contacts the outer surface.

9. The microwave source system of claim 1, wherein the conductive layer comprises an inner conductive layer overlying and contacting the inner surface and an outer conductive layer overlying and contacting the outer surface.

10. The microwave source system of claim 1, wherein the conductive layer comprises a material selected from the group consisting of polycrystalline synthetic diamond and cubic boron nitride.

11. The microwave source system of claim 1, wherein the substrate is formed of a material selected from the group comprising aluminum oxide, beryllium oxide, silicon nitride, aluminum nitride, and quartz.

12. The microwave source system of claim 1, wherein the conductive layer is polycrystalline synthetic diamond and the substrate is quartz.

13. The microwave source system of claim 1, wherein the conductive layer is bonded to the substrate.

14. The microwave source system of claim 1, wherein the conductive layer is deposited upon the substrate.

15. The microwave source system of claim 1, wherein the output dome is prismatic.

16. The microwave source system of claim 1, wherein the output dome comprises a substantially hemispherical cap.

17. The microwave source system of claim 1, wherein the microwave source comprises a magnetron source.

18. A microwave source system, comprising:

a magnetron source comprising a magnetron oscillator source, and a microwave antenna extending outwardly from the magnetron oscillator source; and an output dome covering the microwave antenna, the output dome comprising a ceramic substrate having an inner surface and an outer surface, and a layer of synthetic diamond overlying and contacting at least one of the inner surface and the outer surface.

19. A microwave source system, comprising:

a microwave source including an antenna; and an output dome covering the antenna, the output dome comprising a ceramic substrate having an inner surface and an outer surface, the ceramic substrate having an electrical loss factor of less than about 0.005, and a conductive layer of a high thermal conductivity material overlying and contacting at least one of the inner surface and the outer surface, wherein the conductive layer has a thermal conductivity of at least about 500 watts/meter-° C. and an electrical loss factor of less than about 0.005.

* * * * *